United States Patent [19]

Miyamae

[11] 4,342,455

[45] Aug. 3, 1982

[54] GOLF PUTTING PRACTICE DEVICE

[76] Inventor: Toshiaki Miyamae, 36-8, Aramoto, Higashi-Osaka, Osaka, Japan

[21] Appl. No.: 245,652

[22] Filed: Mar. 20, 1981

[51] Int. Cl.[3] ..... A63B 69/36

[52] U.S. Cl. ..... 273/186 A

[58] Field of Search ..... 273/186 RA, 186 R, 186 A

[56] References Cited

U.S. PATENT DOCUMENTS 4,155,555 5/1979 Fink ..... 273/186 RA

*Primary Examiner*—George J. Marlo

*Attorney, Agent, or Firm*—Moonray Kojima

[57] ABSTRACT

A device for practicing golf putting strokes includes signal members embedded in the putting surface to detect improper movements of the head of the putting club. Each signal member includes a light source and a coacting sensor which detects the light from the coacting light source when it is reflected from the bottom surface of the putter head. The central bottom surface area of the putter head is covered with a non-reflecting surface, while the remaining bottom surface area of the club head is covered with a reflecting substance such as aluminum.

2 Claims, 3 Drawing Figures

GOLF PUTTING PRACTICE DEVICE

BACKGROUND OF THE INVENTION

The present invention relates generally to improvements in a putting practice machine and more in particular to a novel construction of putter swinging indicating machine designed not only to help golf beginner judge right as to their own way of putter swinging motion but also to help skilled golfers repeatedly review their practical putting technique.

In any case when a putter is to be swung by a golfer in putting greens, it is generally pre-requisite for him to motion a putter in the direction of straight line while keeping a putter-head at an exact angle with respect to the supposed extension line along which a golf ball is to be rolled straight so that he is required for a higher swinging technique to always keep the exact position of a putter-head with respect to a golf ball thereby to move the same along a supposed straight line directing to a target hole.

STATEMENT OF OBJECTS

Accordingly, the present invention has been made, among otheres, to provide a novel type putting practice machine that can answer the above-mentioned purpose.

The above and further objects and novel features of the invention will more fully appear from the following detailed description when the same is read in connection with the accompanying drawing. It is also to be expressedly understood, however, that the drawing is for purpose of illustration only and is not intended as a definition of the limits of the invention.

DESCRIPTION OF INVENTION IN RELATION TO DRAWING

Figure 1:
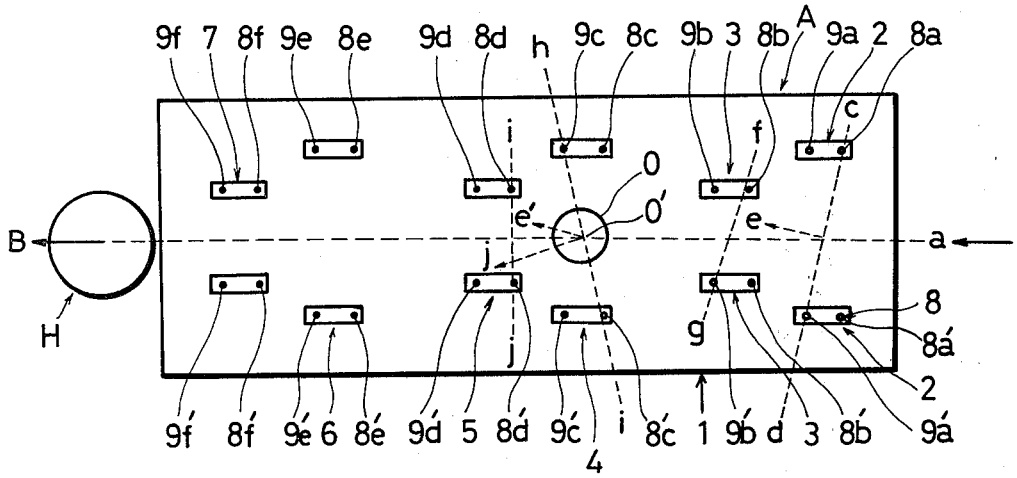
FIG. 1 is a block diagram showing as the whole a putting practice machine carried out in accordance with the present invention.

Setting forth now in details a preferred embodiment of the invention with reference to the accompanying drawing, wherein especially numeral 1 in FIG. 1 generally designates a base of a putting practice machine A of the invention. On said base 1 there are disposed some pairs of signal members 2, 4 and 6 each parallelly in opposite relation with respect to the axis of the base 1 and at properly spaced apart intervals.

Figure 2:
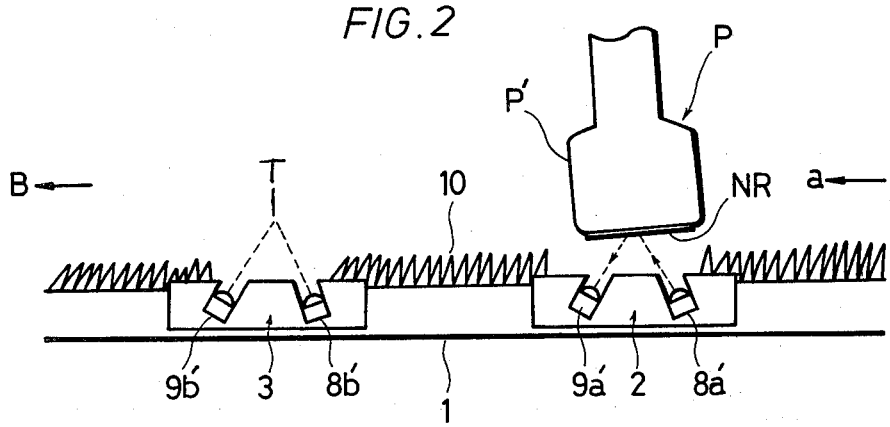
FIG. 2 is a cross elevational view showing how each of signal members is buried in a base of the machine; and, FIG. 3 is a bottom plan view showing the elemental parts of a putter concomitant to the putting practice machine of the invention.
Figure 3:
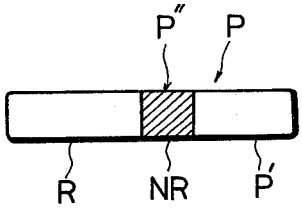

Said signal members 2, 4 and 6 are adapted to exposedly sense light when a putter P or more in particular a head P' thereof is moved at the right angle to said axis as shown in FIGS. 1 and 2. On the other hand, there are also disposed some pairs of signal members 3, 5 and 7 respectively along said axis at properly spaced apart intervals, in a position ahead of said signal elements 2, 4 and 6.

Said signal members 3, 5 and 7 are adapted to sense minute aberrations of said putter-head P'.

All the above-mentioned signal members 2, 4, 6, 3, 5 and 7 are buried therein with a plurality of signal emitting elements 8 made such for example as of an infrared ray emitting element and with a signal sensing element 9 such as a hot transistor (cds), both being exposed in inwardly inclined relation with each other so that they come across on the top T of supposed extension lines as shown by dotted lines in FIG. 2 thereby to form a first pair of signal members 2, 2, a second pair of signal members 3, 3, a third pair of signal members 4, 4, a fourth pair of signal members 5, 5, a fifth pair of signal members 6, 6, and a sixth pair of signal members 7, 7, respectively.

Furthermore for easy reference, said plurality of light emitting elements 8 are herein composed of a pair of elements 8*a*, 8*a'* for the first signal members 2, a pair of elements 8*b*, 8*b'* for the second signal members 3, a pair of elements 8*c*, 8*c'* for the third signal members 4, a pair of elements 8*d*, 8*d'* for the fourth signal members 5, a pair of elements 8*e*, 8*e'* for the fifth signal members 6 and a pair of elements 8*f*, 8*f'* for the sixth signal members 7, respectively.

Likewise for easy reference, said plurality of light sensing elements 9 are herein composed of a pair of elements 9*a*, 9*a'* for the first signal members 2, a pair of elements 9*a*. 9*b'* for the second signal members 3, a pair of element 9*c*, 9*c'* for the third signal members 4, a pair of elements 9*d*, 9*d'* for the fourth signal members 5, a pair of elements 9*e*, 9*e'* for the fifth signal members 6 and a pair of elements 9*f*, 9*f'* for the sixth signal members 7, respectively.

Further according to the invention, said putter-head P' has a particular sweet-point P" disposed substantially in the center thereof, which is covered with a non-reflective substance NR having a smaller width than the width between each of said signal elements 2, 4, 6 and each of said signal elements 3, 5 and 7. All the other bottom surface area of the putter-head P' except for said sweet-point P" is covered with a reflective substance R composed for example of an aluminium foil.

Incidentally, numeral 10 denotes a green cover such as an artificial turf or a piled covering which covers the whole surface of the base 1 of the putting practice machine A in the present invention.

The foresaid signal emitting elements 8 and signal sensing elements 9 may be placed exposedly of the base 1 as long as each light emitted from the former elements 8 is made to reflect by means of said reflective substance R and simultaneously therewith, sensed by said light sensing elements 9.

Referring to FIG. 1 of the accompanying drawing, therefore, said each pair of signal elements are set in such a manner that, once they sense the motion of the putter P in cynchronism, they can send the output signal to a computor (not shown) in the form of 1—1 by the binary scale, but when the putter P advances unilaterally aslant with respect to a straight line, there is obtained either of the signals 1—0 or 0—1.

If a computor is previously set so as to be operated by any one of the above-mentioned three signals to make a display (not shown) show a suitable figure or device corresponding to the signal, a player is visually able to learn how his putting motion has been made by seeing said figure or device.

For a fuller understanding, in case a player has putted a golf ball O with the putter P in such a manner that the latter moves over said first signal members 2, at the right angle with respect to the straight line between the arrows a and b, the putter P is synchronously made to move over the light emitting elements 8*a* of said first signal members 2. Thus there is emitted the signal 1—1 from each of said elements 8*a*, 8*a*', and subsequentially thereto, said putter P is also synchronously made to move over the light emitting elements 8*b*, 8*b*' of the second signal members 3 whereby the player is able to visually confirm how he has swung the putter P.

On the other hand, if the putter P is swung in the position shown by the arrows c and d as illustrated in FIG. 1, then the light sensing elements 9*a* of the first signal members 2 senses the motion of the putter P prior to the light sensing element 9*a*' so that the element 9*a* only sends a signal to a computor to act a display which display then is operated to indicate the numerals 1—0 on the digital plate thereof, enabling a player to visually confirm the inclination of the putter P moved to the straight line between the arrows a and b.

Reference will now be made to the second signal members 3 also shown in FIG. 1. When said sweet-point P'' of the putter P is moved aberrant from the straight line between the arrows a and b, it passes above the light sensing element 9*a* and thereafter the non-reflective portion of the putter P follows so that the element 9*a* indicates the numeral 0 and the element 9*a*' indicates the numeral 1, respectively, on a display, enabling a player to confirm visually as to how aberrant the putter P has moved with respect to the straight line between the arrows a and b.

If in this case the golf ball 0 is disposed between the third signal members 4 on the straight line between the arrows a and b, it is evident that said ball 0 is made to move from the center O' thereof to the direction shown by the arrow e'.

Furthermore in case the putter P above the first signal members 2 is swung in the direction shown by the arrows h and i (for convenience, on the third signal members 4 with respect to FIG. 1), there are indicated on a display from the first signal members 2 and the second signal members 3 the numeral 0—1 which are reverse to the foregoing numeral order.

Moreover, an angle at which the putter P has been swung along the straight line shown by the arrows a and b in the foresaid sequence is sent to a computor in the form of output signal by means of the fifth signal members 6, and the aberration caused to the swinging direction of the putter P is also sent to the computor in the form of numeral 1—0 or 0—1 by means of the sixth signal members 7. Thus a player is able to visually confirm the whole process of his putting motion through a display.

While the specification concludes with claims particularly pointing out and distinctly claiming the subject-matter of the invention, the invention will be better understood from the following description taken in connection with the accompanying drawing.

What is claimed is:

1. In a putting practice machine comprising a flat surface having a center line on which a golf ball may be placed and over which a golf club may be swung, one or more light sources, one or more sensors of said light, which upon said ball or head of said golf club interrupting the light to a respective sensor will generate a signal indicative of the position of said ball or said head, and means for detecting the signals; the improvement comprising a plurality of pairs of signal members positioned within said flat surface, each different ones of said pairs being disposed at different distances from said center line, and each signal member consisting essentially of one said light source and one said sensor, said one light source and said one sensor being positioned at angles with respect to one another so that a straight line extending from said light source will intersect a straight line extending from said sensor at a point about where said ball or said golf club head will pass.

2. The machine of claim 1, wherein said flat surface is covered with artificial turf in areas outside of said signal members.

* * * * *